US006874162B2

(12) United States Patent
Boezi

(10) Patent No.: US 6,874,162 B2
(45) Date of Patent: Apr. 5, 2005

(54) REVERSIBLE JACKET HAVING MULTIPLE HOODS

(75) Inventor: Valentino T. Boezi, Exeter, RI (US)

(73) Assignee: Kaplan-Simon Co., Braintree, MA (US)

( * ) Notice: Subject to any disclaimer, the term of this patent is extended or adjusted under 35 U.S.C. 154(b) by 0 days.

(21) Appl. No.: 10/396,904

(22) Filed: Mar. 25, 2003

(65) Prior Publication Data

US 2004/0187186 A1 Sep. 30, 2004

(51) Int. Cl.[7] ..... A41D 3/02
(52) U.S. Cl. ..... 2/84; 2/DIG. 2
(58) Field of Search ..... 2/69, 69.5, 84, 2/86, 87, 85, 88, 89, 93, 94, 97, 102, 108, 202, 203, 204, 205, 206, DIG. 2

(56) References Cited

U.S. PATENT DOCUMENTS 238,945 A * 3/1881 Marks ..... 2/93
1,033,047 A 7/1912 Cabelinsky
1,052,475 A * 2/1913 Friedman ..... 2/93
1,224,704 A * 5/1917 Berger ..... 2/85
1,485,392 A * 3/1924 Halek ..... 2/84
1,525,322 A * 2/1925 Post ..... 2/84
1,648,250 A * 11/1927 Woislawsky ..... 2/98
1,914,236 A * 6/1933 Berkwits ..... 2/253
1,971,682 A * 8/1934 Hoch ..... 2/85
2,102,251 A 12/1937 Arst
2,138,041 A * 11/1938 Harlan ..... 2/93
2,150,171 A * 3/1939 Max ..... 2/84
2,174,831 A * 10/1939 Muller ..... 112/424
2,322,510 A * 6/1943 Dufine ..... 2/97
2,361,381 A * 10/1944 Callahan et al. ..... 2/93
2,375,562 A * 5/1945 Kaufman ..... 2/93
2,412,988 A * 12/1946 Kleinman ..... 2/93
D156,195 S 11/1949 Block
2,574,716 A * 11/1951 Spatz ..... 2/84
2,682,056 A 6/1954 Werber
2,711,539 A * 6/1955 Loscher ..... 2/93
3,018,486 A * 1/1962 Bukspan ..... 2/87
3,147,490 A 9/1964 Allen et al.
3,523,302 A * 8/1970 Rabedeaux ..... 5/413 R
D244,156 S 5/1977 Boyland
4,103,361 A * 8/1978 Carmen ..... 2/97
4,338,686 A 7/1982 Bell
D276,379 S 11/1984 Duval
4,535,479 A * 8/1985 Paula ..... 2/69.5
4,685,155 A * 8/1987 Fingerhut et al. ..... 2/272
4,771,479 A 9/1988 Silver
5,029,344 A * 7/1991 Shannon et al. ..... 2/69
5,040,243 A * 8/1991 Tatsuno ..... 2/108
D320,181 S 9/1991 Sparham et al.
5,088,116 A * 2/1992 Gould ..... 2/82
5,123,117 A 6/1992 Prendergast
5,133,344 A 7/1992 Jurrius et al.
5,159,718 A * 11/1992 Moyer ..... 2/69
5,182,812 A * 2/1993 Goldsby ..... 2/79
5,369,809 A 12/1994 Hall
5,560,043 A * 10/1996 Armstrong ..... 2/69.5
D381,792 S 8/1997 Haddad
5,718,000 A 2/1998 Ost et al.
5,823,838 A 10/1998 Darcy et al.
5,832,538 A 11/1998 Williams
5,918,314 A * 7/1999 Moses ..... 2/79
6,047,404 A * 4/2000 Blanks et al. ..... 2/69

(Continued)

*Primary Examiner*—John J. Calvert
*Assistant Examiner*—Alissa L. Hoey
(74) *Attorney, Agent, or Firm*—David E. Huang, Esq.

(57) ABSTRACT

The present invention provides a reversible jacket that includes two independently functional flexible hoods that allow a person wearing the jacket to utilize one hood in one configuration of the jacket, and the other hood in a reversed configuration. A reversible jacket of the invention can find a variety of different applications, for example, it can be employed as a camouflage jacket in two different environments.

9 Claims, 9 Drawing Sheets

U.S. PATENT DOCUMENTS 6,083,256 A 7/2000 Der Ovanesian
6,182,296 B1 2/2001 Hosogai
6,263,509 B1 * 7/2001 Bowen ..... 2/69
6,275,993 B1 * 8/2001 McCarley ..... 2/84
6,314,579 B1 11/2001 Marcon
6,345,393 B1 2/2002 Bayer
6,370,692 B1 * 4/2002 Duyn et al. ..... 2/86
6,421,831 B1 7/2002 Korff
6,421,834 B2 7/2002 Kester
6,425,138 B1 7/2002 Johnson
6,550,066 B1 * 4/2003 Brassey ..... 2/93

* cited by examiner

REVERSIBLE JACKET HAVING MULTIPLE HOODS

BACKGROUND OF THE INVENTION

The present invention provides a reversible jacket, and more particularly, a reversible jacket that provides enhanced flexibility to be used as a camouflage jacket in two different environments.

Many reversible jackets are known in the art. Some of these jackets are designed to provide camouflage in two different environments. For example, the fabric pattern of one surface of the jacket can be selected to provide camouflage in a desert environment while the fabric pattern of the opposed surface, i.e., the surface forming the outer surface in a reversed configuration, can be selected to provide camouflage in a different environment.

Such conventional reversible jackets suffer from an important disadvantage in that, when worn for camouflage, any portion of the reversed configuration that is even partially visible can seriously degrade the camouflage quality of the jacket, especially when the two surfaces of the jacket are designed for drastically different environments, e.g., desert and jungle.

Hence, there is a need for a reversible jacket that provides enhanced utility, especially when employed as a camouflage jacket designed for use in two different environments.

SUMMARY OF THE INVENTION

The present invention provides a reversible jacket that includes two separate flexible hoods coupled to the jacket's body in the proximity of jacket's collar such that each hood can be employed independently of the other.

In one aspect, a reversible jacket of the invention includes a flexible body having two opposed surfaces, each of which can form an outer surface of the jacket when worn. That is, one surface can form the jacket's outer surface in one configuration while the opposed surface can form the jacket's outer surface in a reversed configuration. Each of these surfaces can have a selected fabric pattern, which can be the same as or different, e.g., complementary, from that of the other surface. For example, one surface can have a fabric pattern suitable for one environment, e.g., a desert environment, while the other surface can have a fabric pattern suitable for a different environment. The term "fabric pattern," as used herein, can refer to a particular pattern, e.g., checkered, or to a combination of a pattern and one or more colors employed in that pattern. For example, the fabric pattern can be selected to provide camouflage in a particular environment, e.g., a jungle environment. Alternatively, the fabric pattern can refer to a uniform color.

In another aspect, the opposed surfaces can be joined, for example, sewn together, to form a pocket in the jacket having an opening proximate to the jacket's collar, i.e., in proximity of the wearer's head. Each hood can be coupled, for example, sewn, to a portion of the pocket's perimeter.

In a related aspect, one or both of the flexible hoods can be folded into this pocket. For example, when the jacket is worn with one hood, the other hood can be stowed in the pocket. A flap coupled at one edge to the jacket in proximity of the pocket can be employed to cover the pocket's opening, when desired. Further, the flap can include one or more fastening elements, such as, hook-and-loop elements, that can engage with corresponding mating elements, disposed on the back of the jacket proximate to the pocket's opening, to ensure that the flap will remain securely in place when covering the pocket's opening.

In another aspect, the outer surface of each hood can have a fabric pattern corresponding to the fabric pattern of one of the jacket's surfaces, and the inner surface of each hood can have a non-contrasting fabric pattern relative to that of the hood's outer surface. Two non-contrasting fabric patterns, as used herein, refer to two fabric patterns that are not perceived by an observer to be drastically different. In other words, two non-contrasting fabric patterns mesh well with one another. For example, when one fabric pattern is employed for camouflage in one environment, a non-contrasting fabric pattern relative to the camouflage pattern refers to a pattern that would not degrade the stealth quality of the camouflage pattern if utilized in proximity thereof.

In a related aspect, the opposed surfaces of the jacket can be formed of a water-proof material. Further, a thermally insulating layer can be optionally disposed between these layers to provide the jacket with some degree of insulation.

Further understanding of the invention can be obtained by reference to the following detailed description in conjunction with the associated drawings, which are described briefly below.

DETAILED DESCRIPTION

The present invention provides a reversible jacket that includes two independent flexible hoods, each of which can be worn independently of the other. The two flexible hoods allow a person wearing the jacket to wear one hood in one configuration of the jacket, and the other hood in a reversed configuration. As discussed in detail below, this arrangement is particularly advantageous when the two sides of the jacket exhibit two different fabric patterns.

Figure 1:
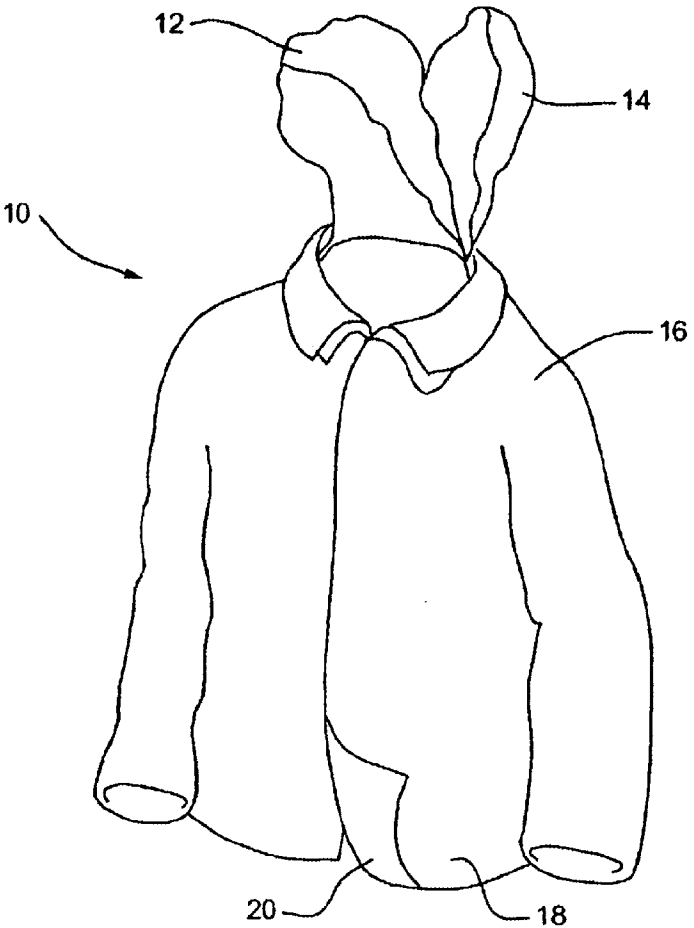
FIG. 1 schematically illustrates a reversible jacket according to the teachings of the invention having two separate functional hoods.

FIG. 1 schematically illustrates a reversible jacket 10 according to the teachings of the invention having two independently functional flexible hoods 12 and 14. The jacket includes a flexible body 16 having two opposed surfaces 18 and 20, each of which can form an outer surface of the jacket. In the illustrated configuration, the surface 18 forms an outer surface of the jacket while the surface 20 forms an inner surface. When the jacket is worn in a reversed configuration, the surface 20 will form the outer surface while the surface 18 will form the inner surface.

The exemplary surfaces 18 and 20, which can be formed of a water-proof material, can exhibit different fabric patterns. For example, in some military applications of a jacket of the invention, the surface 18 can exhibit a camouflage pattern suitable for a given environment, e.g. a desert, while the surface 20 can exhibit another camouflage pattern suitable for a different environment, e.g., a jungle.

Figure 2:
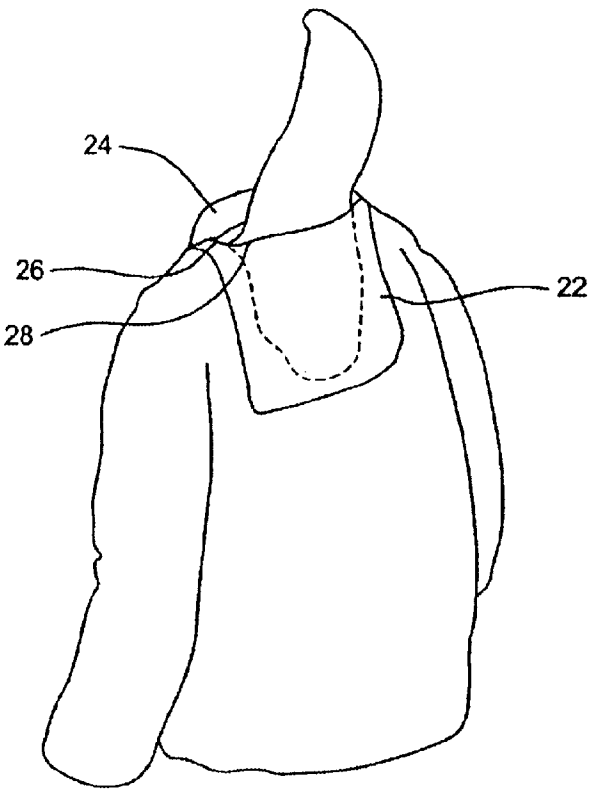
FIG. 2 is a perspective view of the back of the jacket shown in FIG. 1, illustrating a pocket formed in the jacket into which one or both of the hoods can be stowed.
Figure 3:
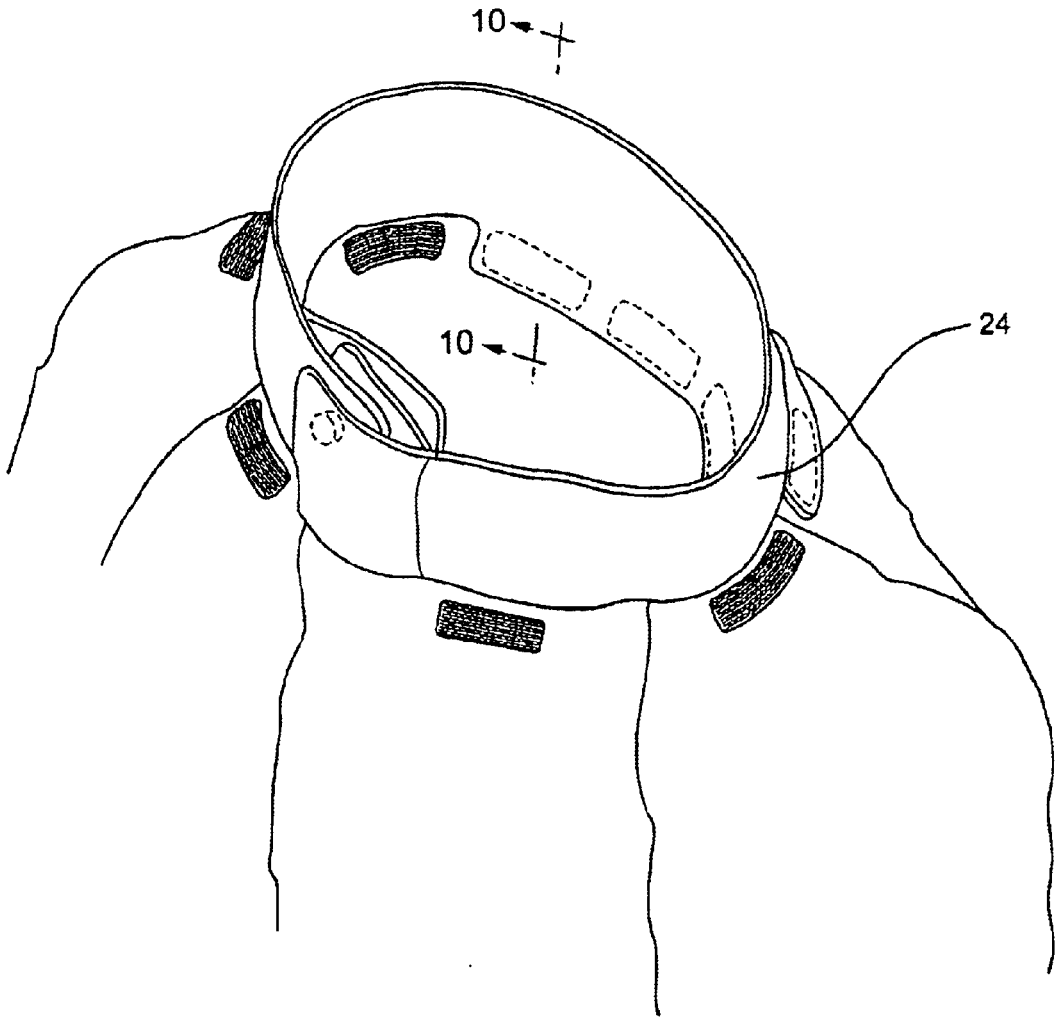
FIG. 3 is a fragmentary perspective view of the jacket of FIG. 1 more clearly illustrating the jacket's collar.
Figure 4:
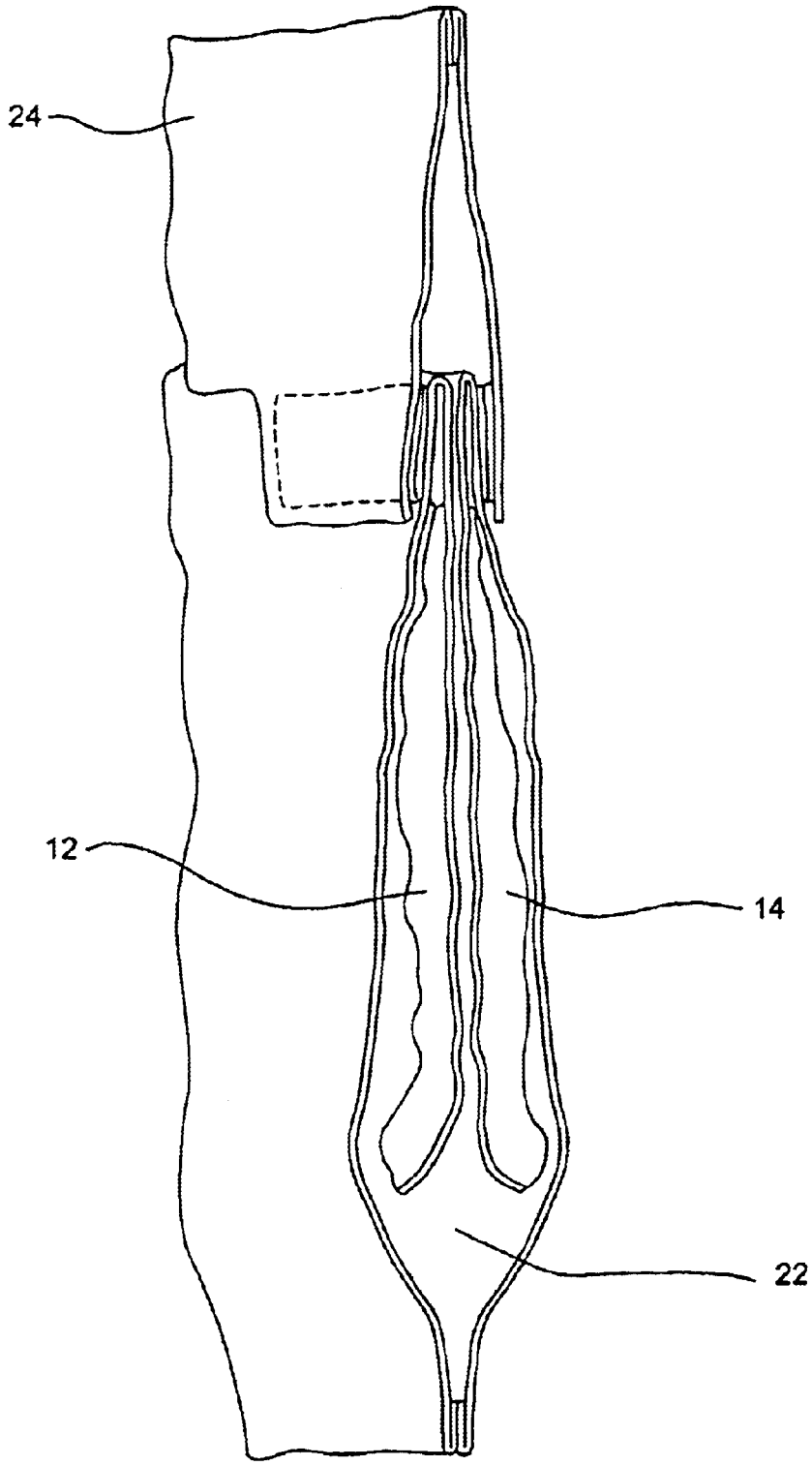
FIG. 4 is a cross-sectional view along line 10—10 of FIG. 3 illustrating the pocket and the hoods folded therein.

With reference to FIGS. 2, 3, and 4, in this exemplary embodiment, the surfaces 18 and 20 are joined together, for example, sewn together, so as to form a pocket 22 in the flexible body 16 proximate to a collar 24 of the jacket, namely, proximate to the head of a person wearing the jacket. The pocket 22 includes an opening 26 having a perimeter 28. The flexible hood 12 is joined to a portion of the perimeter 28 while the other hood 14 is joined to another portion of the perimeter 28. In this fashion, both flexible hoods are positioned in the proximity of a wearer's head such that each hood can function, i.e., can be worn, independently of the other. For example, as discussed in more detail below, the hood 12 can be worn with one configuration of the jacket, for example, the configuration depicted in FIG. 1, while the other hood can be worn in a reversed configuration, i.e., a configuration in which the roles of the surfaces 18 and 20 as outer and inner surfaces are reversed.

As shown in FIG. 2, either of the hoods 12 and 14 can be folded and stowed in the pocket 22 while the other is being utilized. Alternatively, as shown in FIG. 4, which is a cross-sectional view of the jacket of FIG. 3 along the line 10—10, both hoods 12 and 14 can be folded into the pocket 22.

Figure 5:
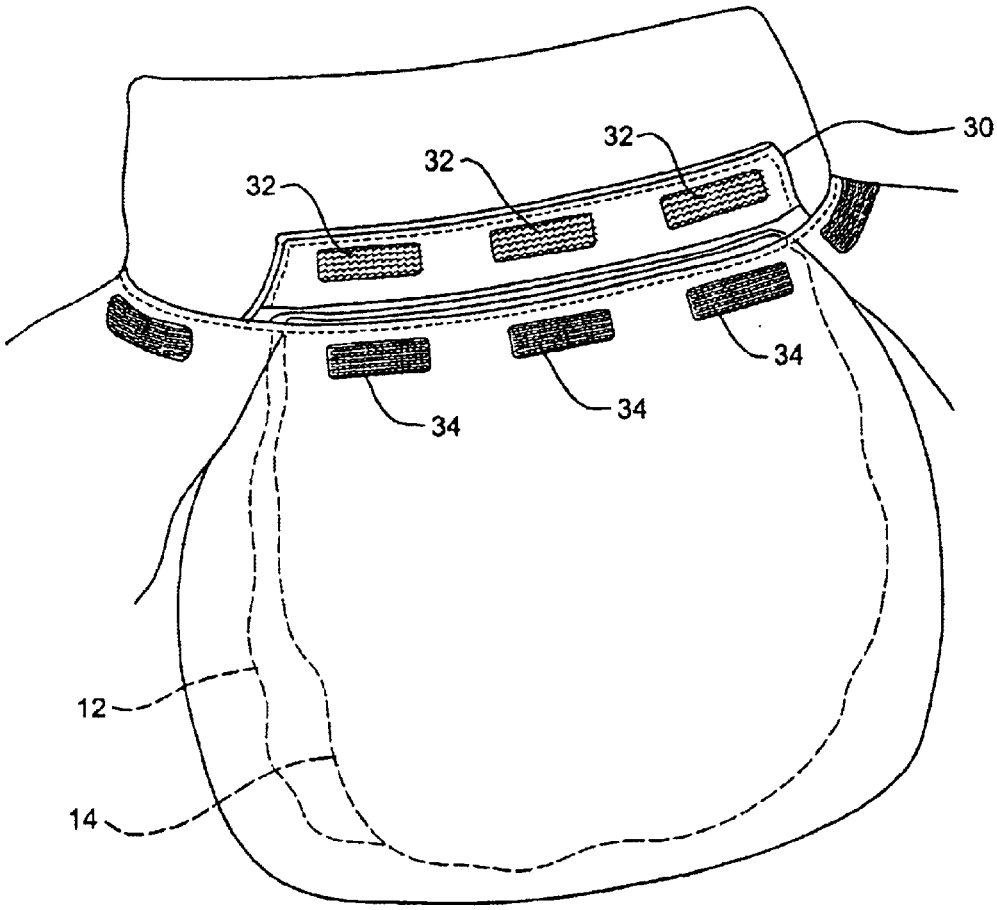
FIG. 5 is a perspective fragmentary view of the back of the jacket of FIG. 1 illustrating a flap that can be used to cover the opening of a pocket formed in the jacket for receiving one or both of the hoods.
Figure 6:
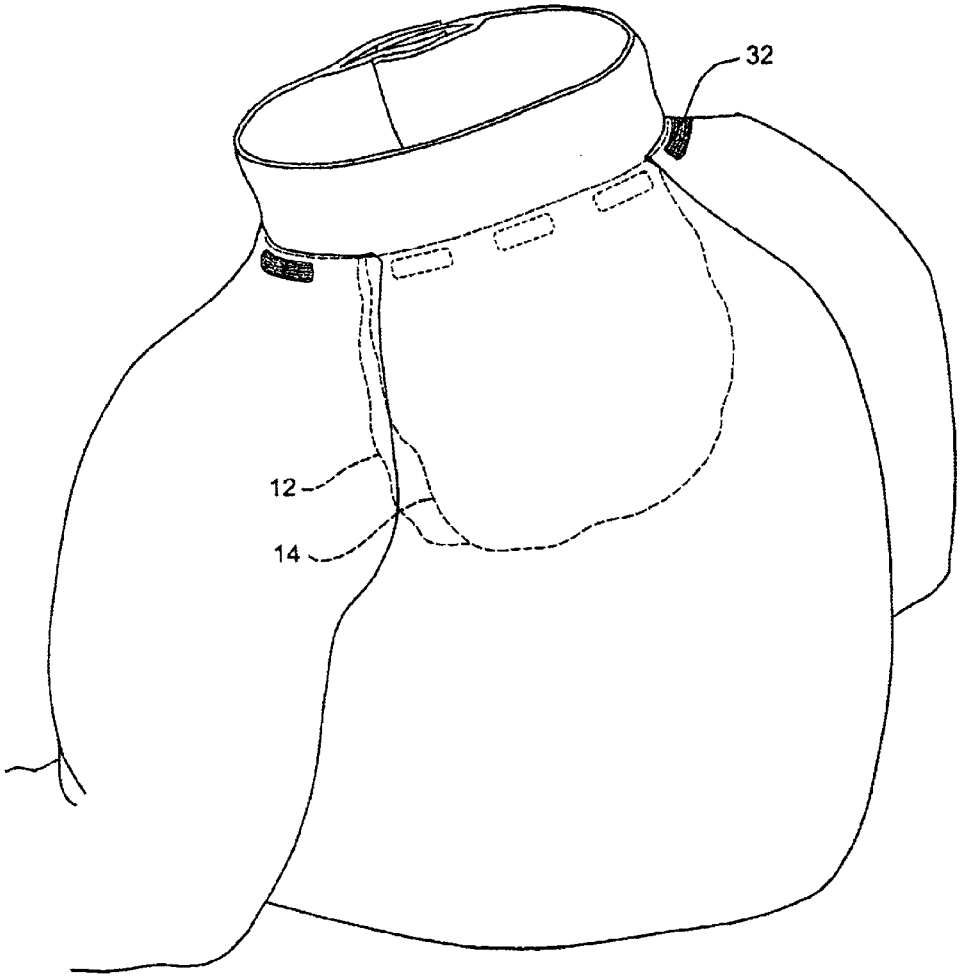
FIG. 6 is a perspective view of the back of the jacket of FIG. 5 illustrating the flap covering the pocket's opening.

With reference to FIG. 5, a flap 30 coupled, e.g., sewn, at one edge to the jacket's body can be optionally employed to cover the opening of the pocket 22. In this exemplary embodiment, the flap 30 includes a plurality of fastening elements 32, in the form of strips of hook-and-loop (for example, Velcro™), that can engage with corresponding mating elements 34, disposed on the back of the jacket in proximity of the jacket's collar, to secure the flap 30 in a position covering the pocket's opening, as shown in FIG. 6. Those having ordinary skill in the art will appreciate that fastening elements other than those described above can also be utilized. For example, buttons, zippers, or studs can be employed.

The flexible hoods can be formed separately from the jacket body and subsequently joined, e.g., sewn or otherwise connected, to the jacket's body. Alternatively, each hood can be formed as a contiguous portion of one of the opposed surfaces 18 and 20. In such a case, upon joining the surfaces together, the hood portions of each surface will be positioned in proximity of the hood portion of the other surface.

Figure 7B:
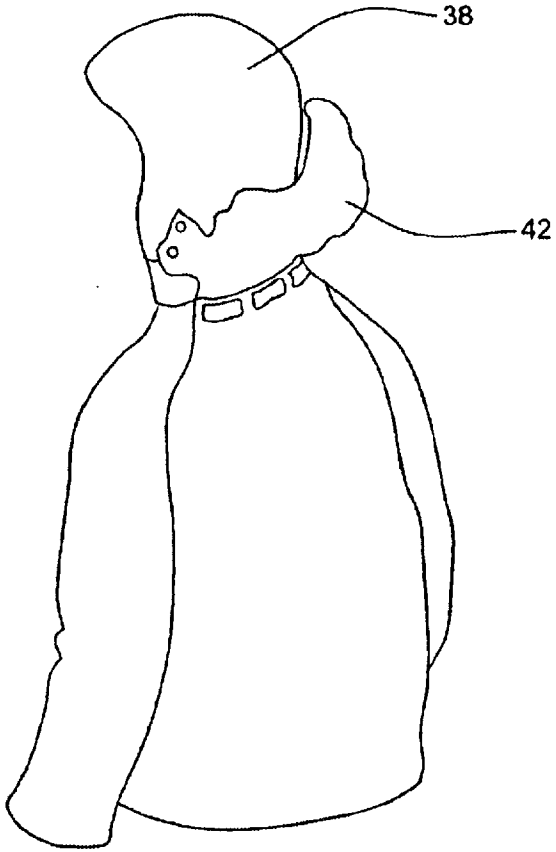
FIG. 7B is a perspective back view of the jacket of FIG. 4A illustrating the outer surfaces of the two hoods.
Figure 7A:
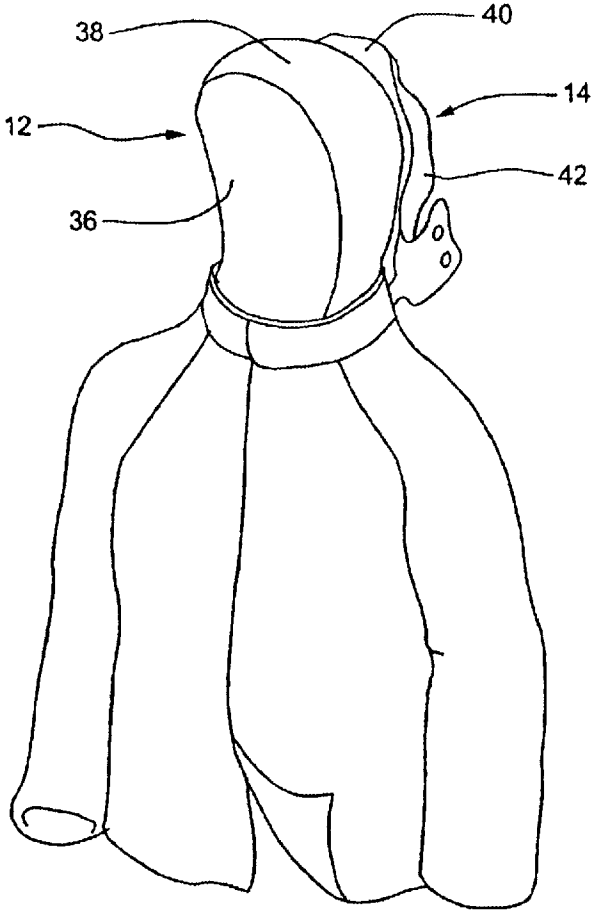
FIG. 7A is a perspective front view of the jacket of FIG. 1 illustrating that each of the two hoods includes an inner surface and an outer surface.

With reference to FIGS. 7A and 7B, the hood 12 includes an inner surface 36, which can be in at least partial contact with a wearer's head when the hood is worn, and includes an opposed outer surface 38. Similarly, the hood 14 includes opposed inner and outer surfaces 40 and 42. In this exemplary embodiment, the fabric pattern associated with the material forming the outer surface 38 of the hood 12 is selected to be the same as that of the surface 18 of the jacket, and the fabric pattern associated with the outer surface 42 of the hood 14 is selected to be the same as that of the surface 16. In this manner, the hood 12 can be worn when the jacket is worn in a configuration in which the surface 18 forms the jacket's outer surface while the hood 14 can be worn when the jacket is worn in a reversed configuration in which the opposed surface 20 forms the jacket's outer surface.

Such matching of the fabric pattern of the outer surface of each hood with that of outer surface of the jacket in a configuration utilizing that hood is particularly advantageous when the reversible jacket 10 is employed as a camouflage jacket. It should, however, be understood that a reversible jacket of the invention can be employed in other applications in which it may be desirable to have different fabric patterns and/or colors for the outer surface of a hood and the outer surface of the jacket in a configuration utilizing that hood.

In this exemplary embodiment, each of the inner surfaces 36 and 40 of the hoods 12 and 14, respectively, exhibits a non-contrasting fabric pattern relative to the outer surface of that hood. In other words, the inner surface and the outer surface of each hood do not appear to an observer, especially when viewed from a distance, as being strikingly different. For example, the inner surface of each hood can exhibit a fabric pattern that is identical to the fabric pattern of that hood's outer surface. Alternatively, in some embodiments, the inner and outer surfaces of each hood do not have identical fabric patterns, but rather, the inner portion exhibits a fabric pattern and a color scheme that readily blends with the color and pattern of the outer surface.

Figure 8:
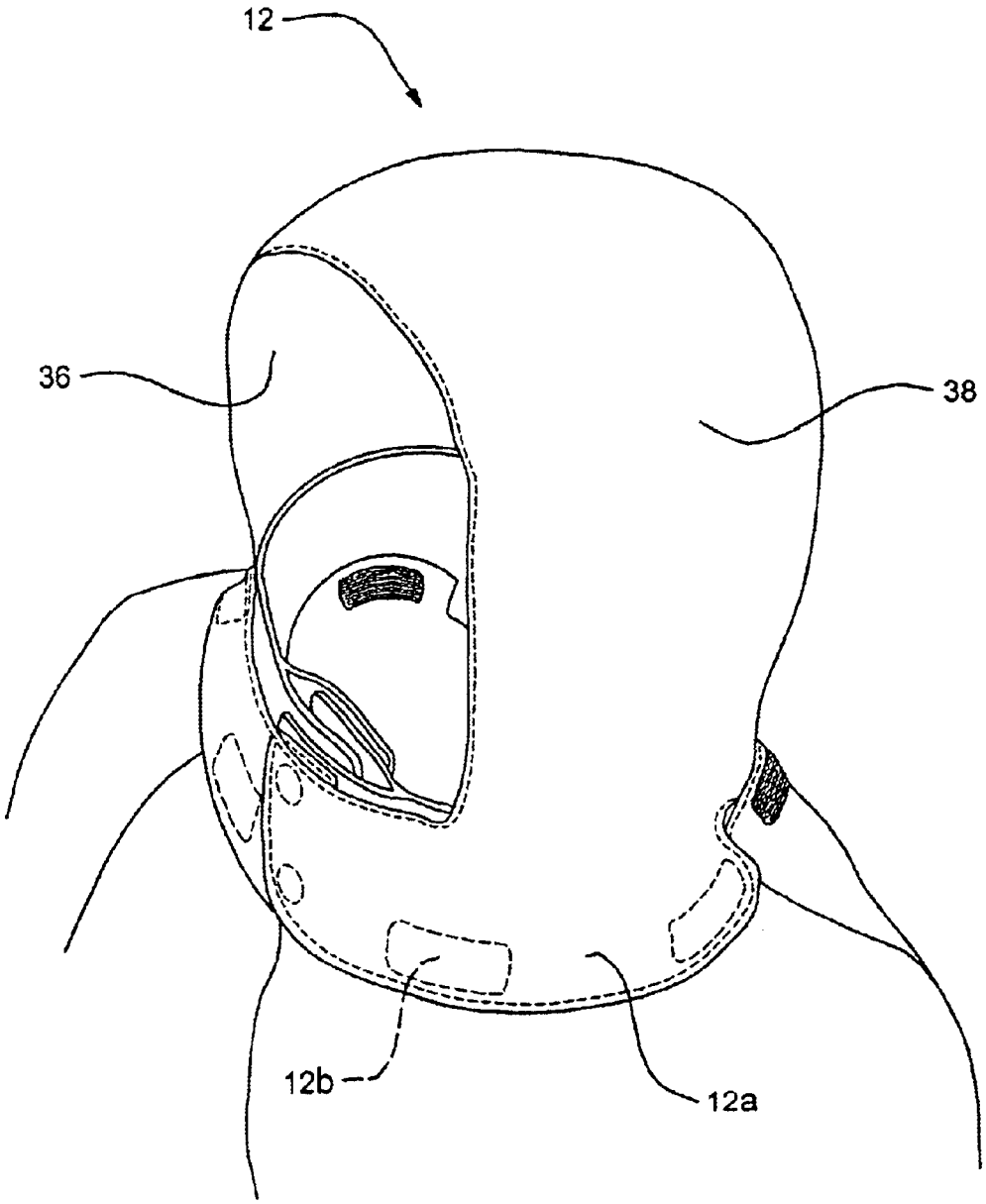
FIG. 8 is a fragmentary front perspective view of the jacket of FIG. 1 illustrating one of the hoods in the deployed position.
Figure 9:
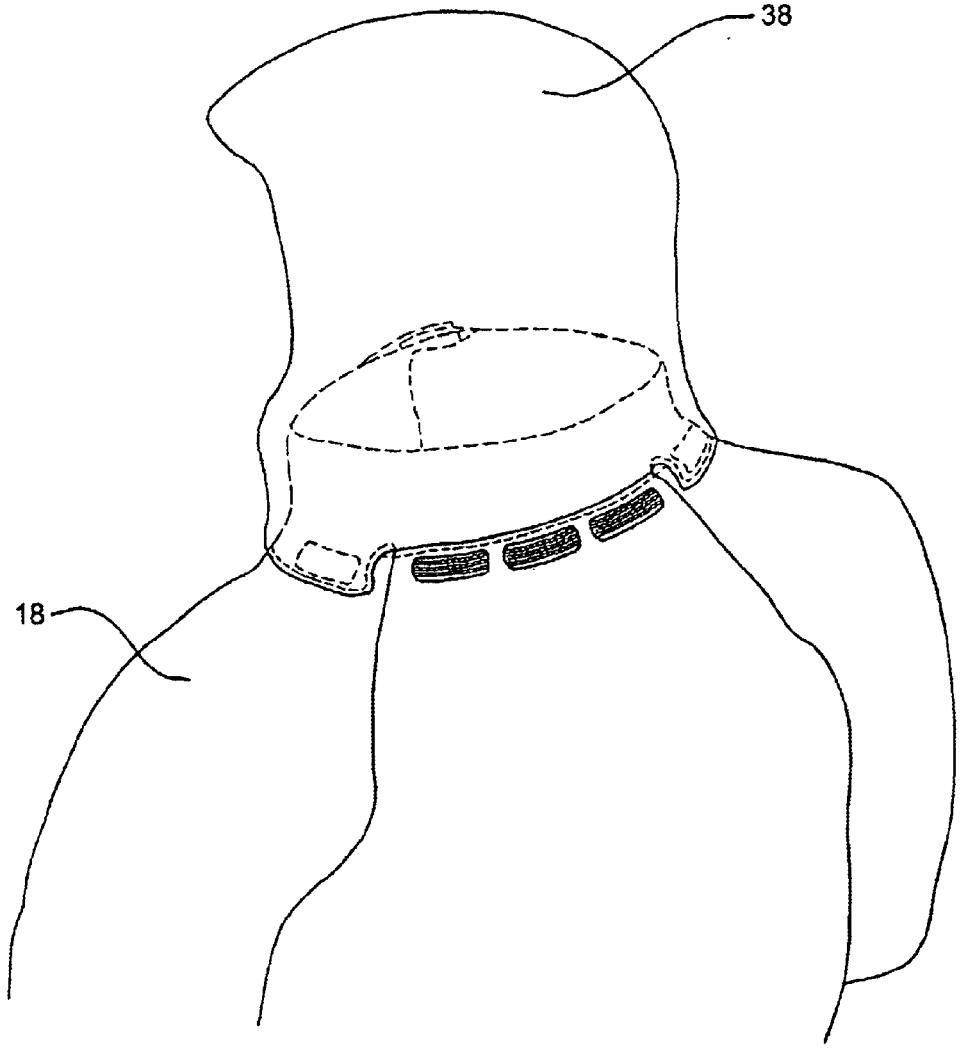
FIG. 9 is a fragmentary back perspective view of the jacket shown in FIG. 8.

For example, with reference to FIGS. 8 and 9, the outer surface 38 of the hood 12 can exhibit a fabric pattern and a color scheme that is suitable for camouflage in a desert environment, and that is identical with the fabric pattern of the jacket's surface. Such a camouflage pattern can be designed, for example, by forming selected shapes in different shades of brown superimposed on a uniform brown background. In such a case, the inner surface 36 can have, for example, a uniform brown color that matches the background color of the camouflage pattern. In this manner, when the hood is worn, even if a portion of the hood's inner surface is visible, it will not degrade the camouflage provided by the jacket.

With continuing reference to FIG. 8, each hood, for example, the illustrated hood 12, can have an optional flap, such as, a flap 12*a* having a plurality of fastening elements 12*b*, e.g., in the form of strips of Velcro™, that can engage with corresponding mating elements (not visible in this figure) to provide a more snug fit for the hood around the wearer's head.

A variety of woven and non-woven materials can be employed for forming a reversible jacket of the invention. The choice of the materials for forming the jacket depends at least in part on a desired application of the jacket. In this exemplary embodiment, the opposed surfaces of the jacket 10 can be formed of flexible water-proof materials. Such water-proof materials can include, but are not limited to, a continuous urethane film, a continuous Teflon™ film, or any other suitable water-proof material. Similarly, at least the outer surface of each hood, and preferably, both the inner and outer surfaces of each hood, can be formed of water-proof materials such as those listed previously.

Figure 10:
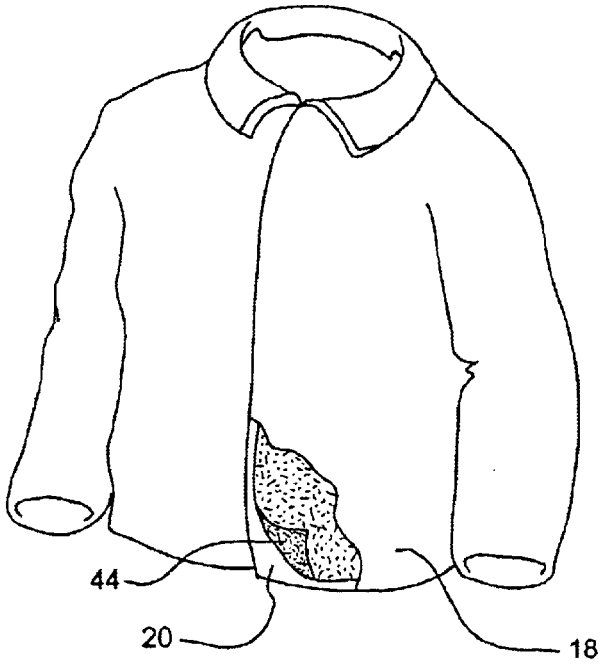
FIG. 10 is a front perspective view of a jacket according to the teachings of invention having a laminated structure, and FIG. 11 schematically illustrates a person wearing a jacket of the invention.

With reference to FIG. 10, in some embodiments, the flexible jacket body 16 has a laminated structure that includes an inner layer 44 disposed between the inner and the outer surfaces 18 and 20. The inner layer 44 can be formed, for example, of a thermally insulating material, such as, insulating materials marketed under trade designation Thinsulate™ by 3M company of Minneapolis, Minn. U.S.A., or any other suitable insulating material, to provide the jacket with a certain degree of heat insulation while the outer surfaces 18 and 20 can be formed of a water proof material.

A reversible jacket of the invention having two independently functional hoods can find a number of different applications. For example, as discussed above, the jacket can be designed as a military camouflage jacket that can be utilized in two different environments. In such an application, one surface of the jacket can exhibit a fabric pattern and a color scheme suitable for use in one environment, e.g., a desert environment, while the opposed surface can exhibit a fabric pattern and a color scheme suitable for use in another environment, e.g., a jungle environment. Further, the fabric patterns of the inner and outer surfaces of each hood can be selected such that each hood would be suitable for use in one of the environments. Hence, the presence of two independently functional hoods in such a jacket advantageously allows the wearer to utilize one hood when the jacket is worn in one environment while employing the other hood when the jacket is utilized, in a reversed configuration, in the other environment.

This provides distinct advantages over a conventional reversible camouflage jacket that includes only one hood. In such a conventional jacket, one surface of the hood can exhibit the camouflage pattern of one side of the jacket, e.g., the desert camouflage, while the other surface of the hood exhibits the camouflage pattern of the reversed side of the jacket. Upon reversing the jacket, the hood also needs to be reversed, i.e., turned inside out, to ensure that the pattern of the outer surface of the hood matches that of the jacket's outer surface. The inner surface of the hood, however, has the pattern of the other side of the jacket. Hence, when the hood is worn, its inner surface, or at least a portion thereof, may be visible. In a combat environment, this can expose the wearer to danger, especially if the fabric patterns of the two sides of the jacket are strikingly different.

Figure 11:
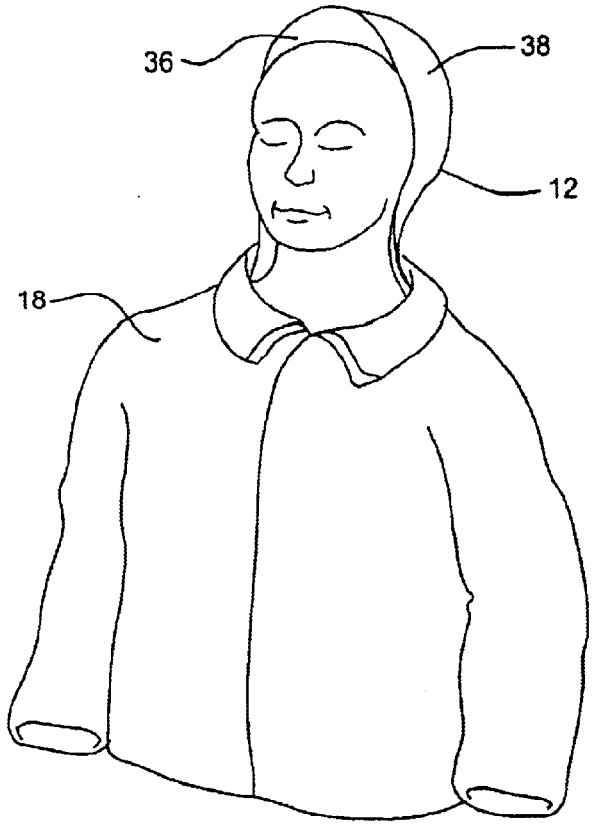

In contrast, each reversible configuration of a jacket of the invention can be worn with a separate hood whose inner and outer surfaces have fabric patterns that mesh well with the pattern associated with the jacket's outer surface in that configuration. For example, with reference to FIG. 11, when a jacket of the invention is worn as a camouflage jacket such that the outer surface exhibits a selected pattern, e.g., a desert pattern, one of the hoods whose outer surface has a pattern identical to that of the jacket's outer surface, and whose inner surface has a pattern that is either identical to that of the jacket's outer surface, or if not identical, it does not exhibit easily recognizable contrast with the pattern of the outer surface, is utilized. In this manner, the inner surface of the hood, e.g., the surface 36, even if partially visible, does not degrade the camouflage provided by the jacket.

A jacket of the invention having multiple independently functional hoods can find applications other than a reversible camouflage jacket. For example, in other applications, one hood can be formed from a water proof material for use in rain and the other hood can be formed of a non-water proof fabric that is more suitable for use in the sun. In another application, a jacket according to the teachings of the invention can be employed by a hunter for hunting in two different environments.

Those having ordinary skill in the art will appreciate that various modifications can be made to the above exemplary embodiments of a reversible jacket of the invention without departing from the scope of the invention.

What is claimed is:

1. A reversible jacket, comprising a flexible body having two opposed surfaces, each of said surfaces having a selected fabric pattern and each being capable of forming an outer surface of the jacket when worn, said surfaces being sewn together so as to form a pocket having an opening proximate to a wearer's head, and two flexible hoods each coupled to at least a portion of a perimeter of said opening.

2. The reversible jacket of claim 1, wherein each hood is capable of being folded into said pocket.

3. The reversible jacket of claim 1, wherein each hood comprises an outer surface and an inner surface, wherein the outer surface of each hood is formed of a fabric pattern corresponding to the fabric pattern of one of the opposed surfaces of the jacket.

4. The reversible jacket of claim 3, wherein the inner surface of each hood exhibits a non-contrasting fabric pattern relative to the fabric pattern of the outer surface of that hood.

5. The reversible jacket of claim 1, wherein said opposed surfaces of the flexible body of the jacket exhibit different fabric patterns.

6. The reversible jacket of claim 1, wherein the fabric patterns of said opposed surfaces of the flexible body are selected for camouflage in two different environments.

7. The reversible jacket of claim 1, wherein said opposed surfaces are formed of a water proof material.

8. The reversible jacket of claim 1, wherein said flexible body comprises an inner layer sandwiched between said two opposed surfaces.

9. The reversible jacket of claim 1, wherein said hood is wearable independently of the other hood.

* * * * *